United States Patent [19]

Perloff

[11] Patent Number: 4,835,945

[45] Date of Patent: Jun. 6, 1989

[54] REDI PAK PRESSURE PRESS AND METHOD

[76] Inventor: Murray Perloff, 2 Ramondo La., Smithtown, N.Y. 11787

[21] Appl. No.: 164,761

[22] Filed: Mar. 7, 1988

[51] Int. Cl.[4] ..... B65B 7/28

[52] U.S. Cl. ..... 53/485; 53/329; 53/390; 53/471

[58] Field of Search ..... 53/235, 266, 329, 390, 53/467, 471, 478, 485; 100/233, 234, 281, 283, 286; 156/306.6, 579, 580, 583.6–583.9

[56] References Cited

U.S. PATENT DOCUMENTS

| | | | |
|---|---|---|---|
| 1,303,083 | 5/1919 | Luna | 100/233 |
| 3,025,652 | 3/1962 | Sandhage et al. | 53/476 X |
| 3,137,111 | 6/1964 | Bostrom | 53/329 X |
| 3,450,031 | 6/1969 | Peterson | 100/233 |
| 3,780,856 | 12/1973 | Braverman | 53/390 X |
| 3,823,054 | 7/1974 | Balzer et al. | 53/329 X |
| 3,988,981 | 11/1976 | McDonald | 156/583.6 X |
| 4,122,651 | 10/1978 | Braverman | 53/471 X |
| 4,322,930 | 4/1982 | Braverman | 53/471 |
| 4,586,316 | 5/1986 | Backman et al. | 53/467 X |

*Primary Examiner*—Robert L. Spruill
*Assistant Examiner*—Ann Tran
*Attorney, Agent, or Firm*—Leonard Belkin

[57] ABSTRACT

A pressure press for preparing a cardlike arrangement for dispensing individual doses of medication without the application of heat which could be detrimental to the efficacy of the medication. The press consists of a base plate having the perforations to accomodate a sheet having pockets for the capsules. A cavity card with pressure sensitive adhesive is placed over the base plate, the card being provided with perforations to permit access to the pockets. The press has a pivoted cover plate to sandwich the card and sheet on the base plate. A pivoted pressure bar assembly is employed to cause the cover plate to exert sufficient pressure on the sandwich to insure adequate sealing.

3 Claims, 2 Drawing Sheets

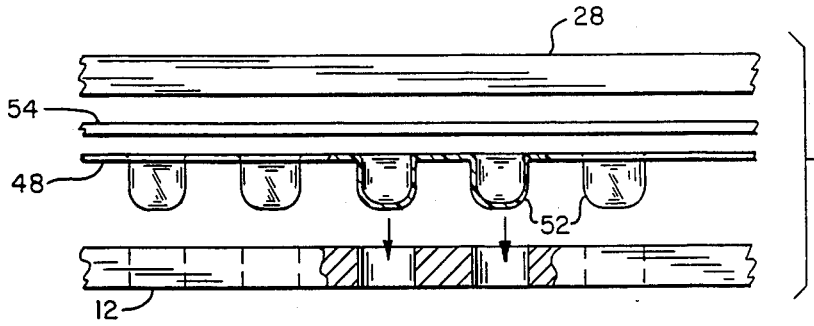
FIG. 3
FIG. 4
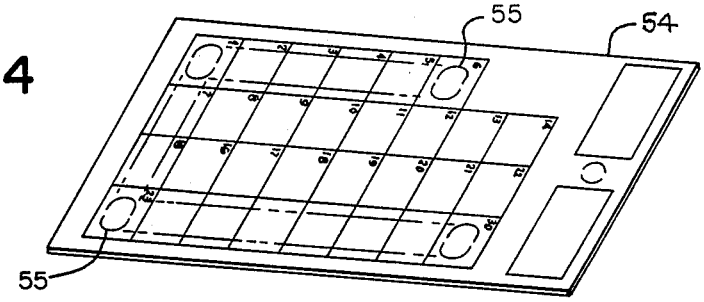
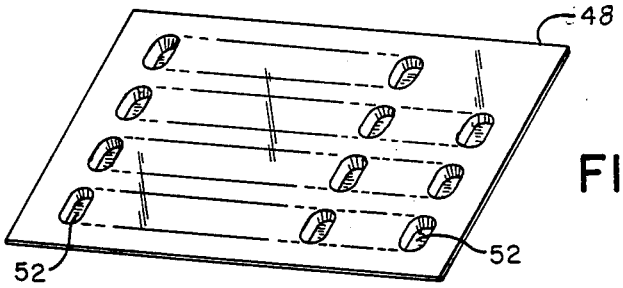
FIG. 5
FIG. 6
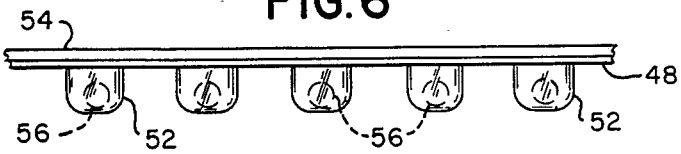
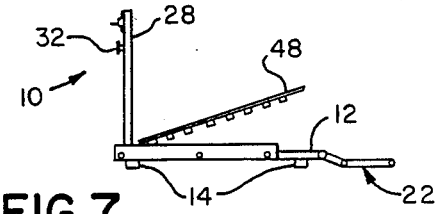
FIG. 7
FIG. 8
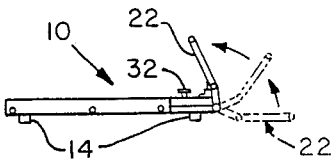

REDI PAK PRESSURE PRESS AND METHOD

BACKGROUND OF THE INVENTION

This invention relates to apparatus for the packaging of drugs in single dosage units and more particularly to packaging apparatus which seals the dosage units without the application of heat.

One common type of packaging for single dose units of drugs or pharmaceuticals is to insert the capsules, tablets, and the like individually in pockets designed to accomodate a single dosage formed in a plastic sheet and overlaying the pockets with a flat sheet having perforated closures for the removal of the capsules in accordance with a particular schedule which may be printed on the overlay itself. This type of arrangement is particularly useful in an institutional environment, such as a hospital, nursing home, extended care facility, etc. where careful control must be exercised over the dispensation of medication to the patients and residents many of whom are incapable of keeping track of their own medication.

Where the making of records for keeping track of such dispensations is relied upon it is readily seen that a technician's failure to enter a notation, which could occur for any one of a variety of reasons, could result in the patient receiving a double, or excessive dose.

For this and other reasons institutions are relying more often on a dispenser which gives a direct indication that the medication has been dispensed, that is, the single dose unit is missing from its pocket which was properly marked by the pharmacist for the time it was to be taken.

One of the difficulties, and often a serious drawback to such an arrangement as described above, is that when the overlay is placed over the plastic tray with the pockets containing the units, heat is employed to seal the parts together. While heat sealing is an effective way of accomplish this result, the fact is that many of the drugs or pharmaceuticals being so packaged are sensitive to heat, even for temperatures not very high and for short periods of time. For example, the prescriptive drug Parlodel, which is often prescribed for a common condition, is extremely sensitive to heat in excess of 77 deg. F. and will deteriorate. In a typical heat sealing operation, temperatures of up to 300 deg. F. are frequently employed for periods up to ten to twenty seconds. Under these conditions there are many pharmaceuticals which can be adversely affected with resulting loss in efficacy.

SUMMARY OF THE INVENTION

In the present invention single dosage units of medication are mounted for convenient use without the application of heat.

A preferred embodiment of this invention consists of a press which includes a bed having openings to accomodate a plastic sheet or tray with pockets into which the individual units of dosage are placed. A cavity card having one surface coated in selected areas with a pressure sensitive adhesive is placed on the plastic sheet or tray, and then a pivoted cover is brought down and a pressure bar swivelled in place to exert pressure on the cover to seal the card and plastic sheet together. As is understood in the art the cavity card is perforated in places to permit access to the pockets one at a time and the card is provided with places for the pharmacist to indicate date and time of dose as well as other information identifying the patient, physician, etc.

Important advantages of the arrangement just described include that it is energy efficient, that is, no electricity is required. Also, there is no warmup time required to use the press, the device is safe and easy to use, and there is no risk of inadvertent damage to the plastic sheet because of a capsule meltdown or plastic burn-through due to excessive length of heat application or excessive temperatures being applied. Another advantage of this invention is due to its small size and low cost. Each pharmacist can have his own press and does not have go out of his way to use one or wait for someone else to complete his operation of the device.

It is thus a principal object of this invention to provide a press for the mounting of individual dosages of medication without the application of heat.

Other objects and advantages of this invention will hereinafter become obvious from the following detailed description of the preferred embodiment of this invention.

BRIEF DESCRIPTION OF THE DRAWINGS

FIG. 3 is an exploded view of the pressure plate, plastic sheet or tray, cavity card, and the cover.

FIG. 4 is an isometric view of the cavity card.

FIG. 5 is an isometric view of the plastic sheet or tray.

FIG. 6 is a side view of the elements shown in FIGS. 4 and 5 assembled and ready to be pressed.

FIG. 7 is a elevation view, partially schematic illustrating how the plastic sheet is inserted into the press.

FIG. 8 is a view similar to that of FIG. 7 illustrating how the press is operated.

DETAILED DESCRIPTION OF THE PREFERRED EMBODIMENT

Figure 1:
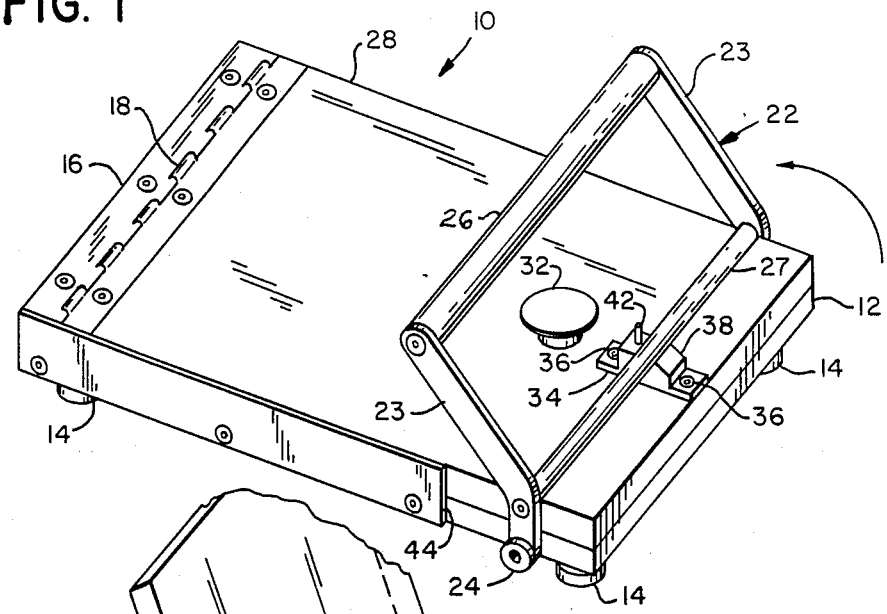
FIG. 1 is an isometric view of a press incorporating the principles of this invention.
Figure 2:
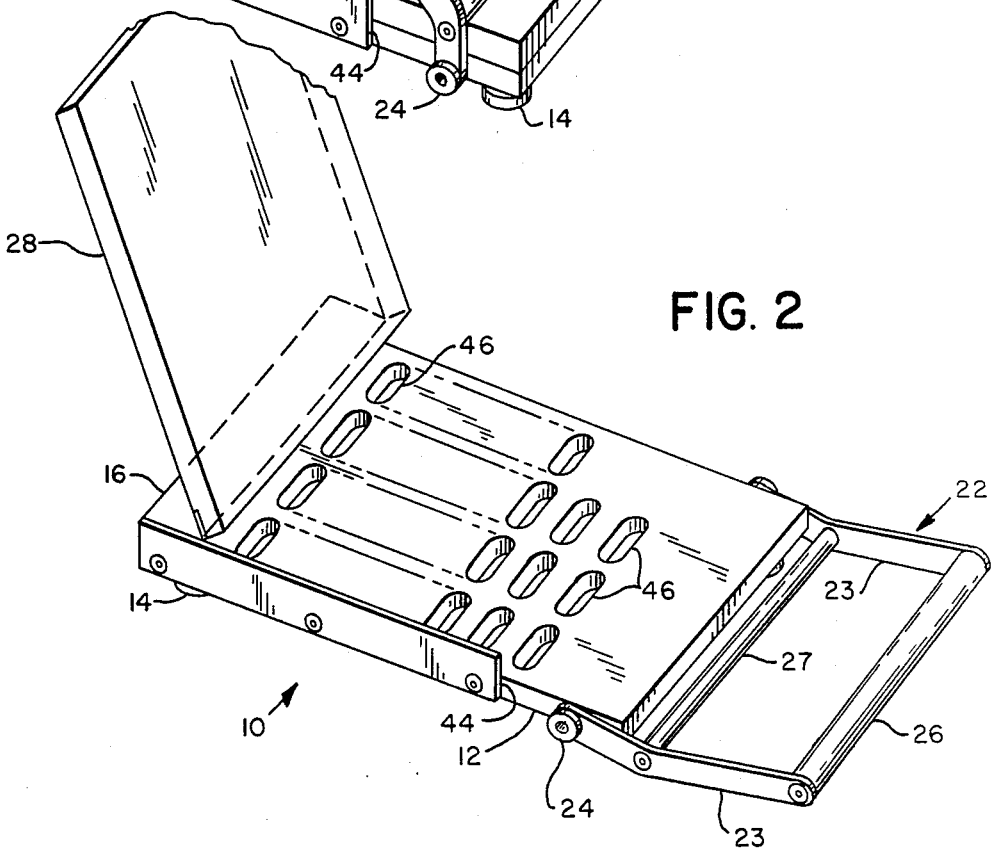
FIG. 2 is a view similar to that of FIG. 1 with the cover open.

Referring to FIGS. 1 and 2, pressure press 10 consists of a flat base or pressure plate 12 supported by rubber tipped legs 14 having mounted thereon at one end a member 16 to support hinges 18 whose purpose will be described below. At the opposite end of plate 12 is mounted a pressure bar assembly 22 whose side arms 23 are hinged on shafts 24 on opposite sides of plate 12 as is illustrated.

Pressure bar assembly 22 includes an extended handle bar 26 connecting arms 23 and an actuating bar 27 whose purpose also will be described later.

A flat cover plate 28 is pivotally mounted at one end on hinges 18 movable between the closed position shown in FIG. 1 and its open position shown in FIG. 2. A knob 32 mounted on the upper surface of plate 28 renders it convenient to move manually plate 28 between its two positions.

Also mounted on the upper surface of plate 28 is a block 34 held in place by a pair of screws 36 and having a sloped camming surface 38. A stop 42 extends from the top of block 34. When pressure bar assembly 22 is pivoted in the direction shown by the arrow in FIG. 1, actuating bar 27 strikes and rides up on camming surface 38 causing cover plate 28 to exert high pressure on plate 12 for reasons which will be gone into below and is eventually halted by stop 42 as seen in FIG. 1.

A guide plate 44 is mounted on the side of base plate 12 to assist in the proper alignment of plates 12 and 28. If needed or desired a second guide plate could be placed on the other side of base plate 12.

Referring to FIG. 2 it will be noted that base plate 12 is provided with a plurality of perforations or holes 46 arranged in columns and rows. As seen in FIGS. 3 a plastic sheet or tray 48, whose shape and construction is also shown in FIG. 5 would be placed on plate 12 with pockets 52 dropping into perforations 46. Consequently, the pockets in plastic sheet 48 are arranged to correspond with perforations 46 in plate 12. Plastic sheet 48 is made from a FDA approved plastic PVC material suitable for use with edible products.

On top of plastic sheet 48 is placed a cavity card 54. The latter is typically a sheet of cardboard whose surface facing plastic sheet 48 is coated with a pressure sensitive adhesive in areas other than those covering pockets 52 when assembled with plastic sheet 48 as shown in FIG. 6. The opposite, or upper surface of card 54 is perforated directly above each pocket in plastic sheet 48 so that the capsule within the pocket below a perforation can be readily removed by pressing in the perforated section. The adhesive which is employed is pressure sensitive, clear, and non-toxic. Adhesives of this type are commercially available.

A typical perforation is shown by numeral 55 in FIG. 4. Adjacent each perforation there would imprinted information as to when the capsule is to be taken by the patient.

Elsewhere on card 54 can be provided information as to the name of the patient, the physician and any other information believed to be pertinent. As has already been noted, the complete assembly of the cavity card and plastic sheet on plate 12 is shown in FIG. 6. Card 54 is made from a solid bleached sulfate cardboard material approved by FDA for use with edible materials.

In the operation of pressure press 10, cover plate 28 is retracted as illustrated in FIGS. 2 and 7. Then plastic sheet 48 is placed on base plate 12 as shown in FIGS. 3, 6, and 8. Capsules 56 are then placed into each individual pocket 52 as seen in FIG. 6. It is understood herein that when reference is made to capsule this would include a tablet, a pill, or any other unit of unit dose of medication, and there could be two or more units each pocket as prescribed by the physician and dispensed by the pharmacist.

Cavity card 54 is placed down on plastic sheet 48 containing capsules 56 with the adhesive coming into contact with sheet 48. Cover plate 28 is then lowered down on cavity card 54 and, as seen in FIGS. 1 and 8, pressure bar assembly 22 is pivoted to apply the necessary force to seal card 54 to plastic sheet 48. Cover plate 28 is raised after retraction of assembly 22 and press 10 is then ready for the next prescription to be filled.

It is thus seen there has been provided a unique pressure press for the manufacture of a card assembly for dispensing drug items pursuant to a prescription or other program for dispensing such products.

The apparatus of this invention is simple in construction, easy and convenient to operate, requires no electric or other power source, and perhaps most important, the absence of the application of heat completely avoids the detrimental affects often associated with the application of heat to drug items.

While only one preferred embodiment of this invention has been described, it is understood that many variations of this invention are possible without departing from the principles of this invention. For example, while cover plate 28 is shown and described as being hinged, the press can be made with the plate merely being placed on base plate 12. In addition, instead of employing pressure bar assembly 22 to apply the required pressure, various other means such as pneumatic, hydraulic and other mechanical and electrical arrangements are available depending on the particular circumstances.

What is claimed is:

1. A pressure press for the assembly and sealing without the application of heat of apparatus for dispensing individual doses of medication and the like comprising:

a. an extended sheet having formed therein spaced pockets into which unit does are placed;

b. a stationary base plate on which said sheet is placed and having perforations to accomodate said pockets;

c. a cavity card placed on said sheet for enclosing said pockets, said card having perforated closures aligned with said pockets to permit access to each of said pockets, said card being coated with pressure sensitive adhesive on the side making contact with said sheet only in areas other than those above said pockets;

d. a cover plate pivotally mounted on said base plate for coming into contact with said cavity card thereby sandwiching said card and sheet between said cover plate and base plate;

e. actuator means to cause said cover plate to apply sufficient pressure for a sufficient length of time to cause said cavity card to adhere to said extended sheet thereby sealing each of said doses in a pocket; said actuator means comprising a pressure bar assembly independently pivoted on said base plate to come into contact with said cover plate to exert sufficient force to cause the adhesive to be effective; and f. said cover plate being provided with a block having a camming surface to receive contact from said pressure bar assembly to transmit said force to said cover plate and means to prevent excessive force from being applied.

2. The method of sealing a cavity card to a sheet having pockets into which unit dosages of medication are placed comprising the steps of placing said sheet on a base plate having openings completely therethrough to accomodate said pockets permitting the the latter to pass completely through said plate, placing said card on said sheet and having a coating of pressure sensitive adhesive only in areas to make contact with said sheet, pivoting a cover plate hinged on said base plate to form a sandwich of said card and sheet between the cover and base plates said cover plate having a camming block, and pivoting independently of said cover plate on said base plate an arm assembly to make contact with said cover plate on said camming block to bring sufficient force on said sandwich to effect sealing of said card to said sheet.

3. The apparatus of claim 1 wherein said camming block includes a stop to halt movement of said pressure bar assembly.

* * * * *